US011374324B2

(12) United States Patent
Hung

(10) Patent No.: US 11,374,324 B2
(45) Date of Patent: Jun. 28, 2022

(54) SLOTTED PATCH ANTENNAS

(71) Applicant: HEWLETT-PACKARD DEVELOPMENT COMPANY, L.P., Spring, TX (US)

(72) Inventor: Kuan-Jung Hung, Taipei (TW)

(73) Assignee: Hewlett-Packard Development Company, L.P., Spring, TX (US)

( * ) Notice: Subject to any disclaimer, the term of this patent is extended or adjusted under 35 U.S.C. 154(b) by 162 days.

(21) Appl. No.: 16/481,477

(22) PCT Filed: Jul. 17, 2017

(86) PCT No.: PCT/US2017/042332
§ 371 (c)(1),
(2) Date: Jul. 28, 2019

(87) PCT Pub. No.: WO2019/017868
PCT Pub. Date: Jan. 24, 2019

(65) Prior Publication Data
US 2021/0336343 A1 Oct. 28, 2021

(51) Int. Cl.

| | |
|---|---|
| ***H01Q 9/04*** | (2006.01) |
| ***H01Q 1/22*** | (2006.01) |
| ***H01Q 1/36*** | (2006.01) |
| ***H01Q 9/40*** | (2006.01) |
| ***H01Q 13/10*** | (2006.01) |

(52) U.S. Cl.
CPC ..... *H01Q 9/0421* (2013.01); *H01Q 1/2266* (2013.01); *H01Q 1/36* (2013.01); *H01Q 9/0442* (2013.01); *H01Q 9/40* (2013.01); *H01Q 13/106* (2013.01)

(58) Field of Classification Search
CPC .... H01Q 1/2266; H01Q 13/10; H01Q 13/103; H01Q 13/106; H01Q 9/0407; H01Q 9/0414; H01Q 9/0421; H01Q 9/0442; H01Q 9/40; H01Q 1/36; H01Q 1/243; H01Q 13/18
See application file for complete search history.

(56) References Cited

U.S. PATENT DOCUMENTS

| | | | | |
|---|---|---|---|---|
| 6,181,281 | B1 | 1/2001 | Desclos et al. | |
| 6,448,933 | B1 * | 9/2002 | Hill | H01Q 1/241 343/702 |
| 6,670,923 | B1 * | 12/2003 | Kadambi | H01Q 1/243 343/700 MS |

(Continued)

FOREIGN PATENT DOCUMENTS

| | | |
|---|---|---|
| CN | 1525598 A | 9/2004 |
| CN | 1788390 | 6/2006 |

(Continued)

OTHER PUBLICATIONS

Supplemental European Search Report EP 17 91 8436 (Year: 2020).*

(Continued)

*Primary Examiner* — Ricardo I Magallanes
(74) *Attorney, Agent, or Firm* — HPI Patent Department

(57) ABSTRACT

The present subject matter describes antennas. In an example of the present subject matter, an antenna comprises a patch antenna element having a radiating surface. Two slots are formed on the radiating surface, each of the two slots having an open circuit edge and a short circuit edge.

9 Claims, 7 Drawing Sheets

(56) References Cited

U.S. PATENT DOCUMENTS

| | | | | |
|---|---|---|---|---|
| 8,325,096 | B2 | 12/2012 | Vazquez et al. | |
| 8,648,752 | B2 | 2/2014 | Ramachandran et al. | |
| 8,749,439 | B2 | 6/2014 | Rao et al. | |
| 8,872,708 | B2 | 10/2014 | Hill et al. | |
| 9,203,139 | B2 | 12/2015 | Zhu et al. | |
| 2003/0011521 | A1 | 1/2003 | Edimo et al. | |
| 2003/0020659 | A1* | 1/2003 | Kushihi | H01Q 13/10 343/702 |
| 2003/0160728 | A1 | 8/2003 | Fukushima | |
| 2003/0201943 | A1 | 10/2003 | Kadambi et al. | |
| 2004/0169611 | A1 | 9/2004 | Korva | |
| 2004/0257283 | A1 | 12/2004 | Asano et al. | |
| 2005/0237251 | A1* | 10/2005 | Boyle | H01Q 13/16 343/846 |
| 2006/0038721 | A1 | 2/2006 | Ozkar | |
| 2011/0012790 | A1 | 1/2011 | Badaruzzaman et al. | |
| 2012/0026048 | A1* | 2/2012 | Vazquez | H01Q 1/38 343/725 |
| 2012/0306721 | A1 | 12/2012 | Okegawa et al. | |
| 2014/0347225 | A1 | 11/2014 | Harper | |

FOREIGN PATENT DOCUMENTS

| | | |
|---|---|---|
| EP | 2750247 | 7/2014 |
| KR | 101415749 | 7/2014 |

OTHER PUBLICATIONS

Written Opinion of the International Searching Authority for PCT/US 2017/042332 (Year: 2018).*

Hu, Z-W et al, "Hybrid Antenna Design Integrated with the Metal cover of Notebook", Jul. 26-29, 2016.

Frequency-Diversity Patch Antenna for WiBro and Satellite-DMB. Zhou Xilang, Microwave technology and antenna, Sep. 30, 2015, p. 531, Southeast University Press.

* cited by examiner

SLOTTED PATCH ANTENNAS

BACKGROUND

Electronic devices, such as laptops and cellular phones, include antennas for wireless communication. Such antennas may be mounted in an enclosure or housing of the electronic device. The antennas have wireless communication capabilities to communicate with wireless networks and satellite navigation systems.

BRIEF DESCRIPTION OF DRAWINGS

The following detailed description references the drawings, wherein.

DETAILED DESCRIPTION

Figure 1:
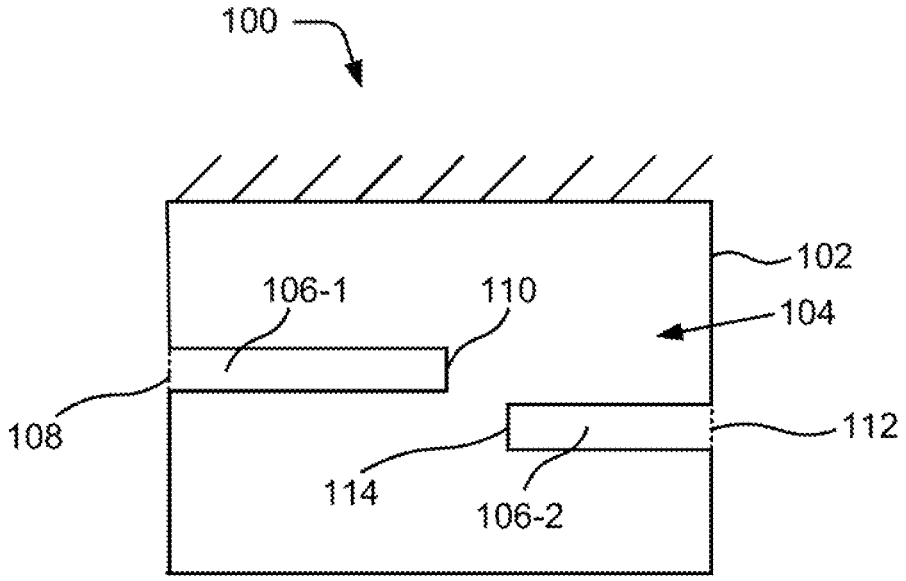
FIG. 1 illustrates an antenna, according to an example implementation of the present subject matter.

Wireless antennas are mounted within compact electronic devices, such as laptops, tablets, smartphones etc. These compact electronic devices include a variety of other electronic components, such as processor(s), memory, power source, cooling fans, I/O ports, etc., for functioning. Hence there may be a shortage of physical space for mounting of antennas within these devices, and it may be challenging to accommodate wireless antennas in constrained spaces within the electronic devices.

Further, tuning of wireless antennas, such as micro-strip antennas or patch antennas, may be complex when they are to be operated for transceiving WiFi signals, such as signals having frequency in 2.4 Giga Hertz (GHz) and 5 GHz frequency bands. Wireless patch antennas which meet the bandwidth and signal strength specifications for operation in 2.4 GHz and 5 GHz frequency bands, may have large physical dimensions due to which such antennas may not fit in the constrained spaces within the electronic devices.

Further, in a laptop, a wireless antenna is generally housed inside a base enclosure of the laptop which holds a keyboard and encloses a variety of other electronic components, such as processor(s), memory, etc. While positioning the antenna in the enclosure, certain pre-defined clearances are to be maintained between the antenna and the other electronic components so that radiations from the antenna do not interfere with functioning of the other components. Positioning the antenna within the enclosure may also result in an increase in specific absorption rate (SAR) associated with the radiations from the antenna at the bottom part of the enclosure. This may result in over heating of the bottom part of the enclosure of the electronic device.

Furthermore, the enclosure may have some portions made of metal. Antennas are generally mounted in a slot provided within the metal portion of the enclosure. The slot for the antenna, also called an antenna window, may be a cut-out in the metal portion. The antenna is placed in the slot and then the slot is covered with a plastic filling member. The radiations from the antenna are transmitted through walls of the plastic filling member. The plastic filling member is then coated with metal-finish paints in order to give the plastic filling member an appearance similar to the surrounding metal portion of the enclosure. Cutting, a slot in the metal portion, positioning the antenna in the slot, covering the slot with the plastic filling member, and coating the plastic filling member with metal-finish paints involves additional material cost of the plastic filling member and the metal-finish paints and also involves additional production steps and production time.

The present subject matter relates to antennas for electronic devices. In an example implementation of the present subject matter, an antenna includes a patch antenna element with two slots formed on a radiating surface of the patch antenna element. Each of the two slots has an open circuit edge and a short circuit edge.

The two slots on the radiating surface of the patch antenna element help in obtaining a compact antenna without compromising signal strength and bandwidth specifications of the antenna. The slots may control the resonance frequencies of the antenna and thereby enable shifting of the resonance frequencies. With the slots formed on the radiating surface of the patch antenna element, the resonance frequencies can be shifted in such a manner that the operational bandwidth and signal strength specifications are met and yet the antenna is compact.

In an example implementation, one of the two slots may be tuned to operate in 2.4 GHz frequency band and the other of the two slots may be tuned to operate in 5 Giga Hertz frequency band. The slots may be tuned by controlling their physical design and/or dimensions or by being coupled to circuit components, such as tuning capacitors, inductors, etc. Thus, the antenna can be operated as a dual-band antenna which can reliably receive signals over a wireless Local Area Network (WLAN). Further, the physical dimensions of each of the slots may be varied to tune the antenna, thus the antenna of the present subject matter provides tuning flexibility.

Further, since the antennas of the present subject matter are compact they can be accommodated within a frame of a display unit of a laptop. Thus, the challenges associated with placing the antenna in the base enclosure may be eliminated.

The following detailed description refers to the accompanying drawings. Wherever possible, the same reference numbers are used in the drawings and the following description to refer to the same or similar parts. While several examples are described in the description, modifications, adaptations, and other implementations are possible. Accordingly, the following detailed description does not limit the disclosed examples. Instead, the proper scope of the disclosed examples may be defined by the appended claims.

FIG. 1 illustrates an antenna 100, according to an example implementation of the present subject matter. The antenna 100 includes a patch antenna element 102. In an example implementation, the patch antenna element is one of a microstrip patch antenna and a microstrip shorted patch antenna.

On one face of the patch antenna element 102, microstrip patches may be deposited. The microstrip patches may include metallic radiator plates. The face of the patch antenna element on which microstrip patches are deposited is referred to as a radiating surface. Such a radiating surface 104 of the patch antenna element 102 is illustrated in FIG. 1.

As shown in FIG. 1, a first slot 106-1 and a second slot 106-2 are formed on the radiating surface 104. The first slot 106-1 has an open circuit edge 108 and a short circuit edge 110. The second slot 106-2 also has an open circuit edge 112 and a short circuit edge 114.

Figure 2:
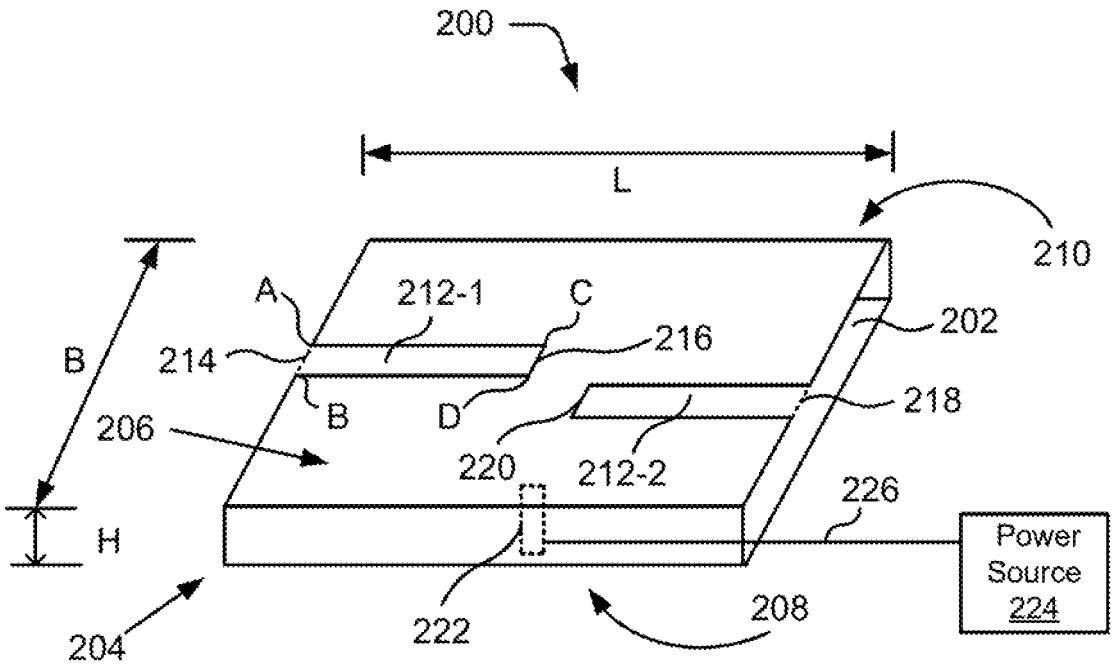
FIG. 2 illustrates a perspective view of an antenna, according to an example implementation of the present subject matter.

FIG. 2 illustrates a perspective view of an antenna 200, according to an example implementation of the present subject matter. The antenna 200 includes a patch antenna element 202. The patch antenna element 202 includes a cuboidal antenna holder 204. In an example implementation, the cuboidal antenna holder 204, also referred to as the antenna holder 204, may be a hollow or solid structure made of a di-electric material, such as plastic, glass, ceramic, or a combination thereof. In an example implementation, the antenna holder 204 has a length 'L' in a range of about 25 mm to 35 mm, a breadth 'B' in a range of about 8 mm to 12 mm, and a height 'H' in a range of about 3 mm to 4.5 mm.

Radiating structures of the patch antenna element 202 may be formed on one face of the cuboidal antenna holder 204. The radiating structures include printed circuit components deposited on a face of the cuboidal antenna holder 204 in the form of microstrip patches. In an example implementation, microstrip patches may be deposited by use of a patterning technique of metal deposition. The face of the cuboidal antenna holder 204 on which the microstrip patches are deposited is referred to as a radiating surface 206 of the patch antenna element 202.

In an example implementation, a face 208 of the antenna holder 204 opposite to the radiating surface 206 may be completely coated with a metal layer. The face 208 of the antenna holder 204 coated with a metal layer and opposite to the radiating surface 206 is referred to as a metal plane 208. In an example implementation, the metal layer may be coated by painting a metal paint on the di-electric material or through electroplating using metal foils. The metal plane 208 functions as a grounding plane of the antenna 200.

As shown in FIG. 2, a sidewall 210 of the antenna holder 204 may also be coated with metal. The sidewall 210, also referred to as a metallic sidewall 210, lies between the metal plane 208 and the radiating surface 206. The metallic sidewall 210 acts as an electrical short circuit between the metal plane 208 and the radiating surface 206 and thereby may control the current distribution variation on the radiating surface 206. Due to the presence of the metallic sidewall 210 that electrically shorts the radiating surface 206 with the metal plane 208, the patch antenna element 202 is also referred to as a shorted patch antenna element.

As shown in FIG. 2, two slots are formed on the radiating surface 206. A first slot 212-1 formed on the radiating surface 206 has an edge 214. The edge 214 is formed at a junction, of two faces of the antenna holder 204. The junction is formed from the di-electric material of the antenna holder 204 and there are no metal coatings or metallic interconnections present at the junction. Thus, endpoints A and B of the edge 214 are electrically isolated from each other. Hence, the edge 214 may be referred to as a first open circuit edge 214 of the first slot 212-1.

An edge 216 of the first slot 212-1, opposite to the edge 214, as both its ends, C and D, electrically shorted by a metallic connection. In an example implementation, the metallic connection may be formed while forming the radiator structures on the surface 206 or may be in the form of a short-wire connecting the end points, C and D, of the edge 216. Thus, the edge 216 may be referred to as a first short circuit edge of the first slot 212-1. In an example implementation, the first slot 212-1 may be tuned to transceive antenna signals at 2.4 GHz frequency band.

Likewise, a second slot 212-2 formed on the radiating surface 206 also has a second open circuit edge 218 and a second short circuit edge 220. The second open and short circuit edges 218 and 220 may have similar characteristics as that of the first open and short circuit edges 214 and 216. In an example implementation, the second slot 212-2 may be tuned to transceive antenna signals at 5 GHz frequency band. Although in FIG. 2, two slots are shown to be formed on the radiating surface 206, in an example implementation, more than two slots may be formed on the radiating surface 206.

The first and second slots 212-1 and 212-2 may be formed by selectively coating the antenna holder 204 with metal. In an example implementation, to form radiating structures of the patch antenna element 202, a metal layer may be selectively coated on pre-determined portions of a surface of the antenna holder 204. This selective coating of metal may be performed by a microstrip antenna patterning technique. Portions on which the metal layer is deposited act as radiating structures of the patch antenna element 202 and portions on which the metal layer is absent form the slots which enable to control and tune the resonant frequencies. In another example implementation, during fabrication of the antenna, the antenna holder 204 is coated with metallic strips having openings in them, where the openings are shaped like slots. The metallic strips can be coated on the antenna holder through electroplating using metal foils or other metal deposition techniques. Once the metallic strips with the openings are formed on the plastic antenna holder, the openings in the metallic strips form the slots. Although in the Figures, the slots are illustrated as being straight-cut slots, the slots may be formed in various designs and shapes.

Further, the patch antenna element 202 includes a feeding element 222 which connects the radiating surface 206 with a power source 224. In an example implementation, the feeding element 222 may be a pogo pin that establishes connection between a feed cable 226 emanating from the power source 224 and the radiating surface 206. The feeding element 222 is positioned in a hollow portion within the antenna holder 204 and an end of the feeding element 222 is soldered at the radiating surface 206.

Figure 3:
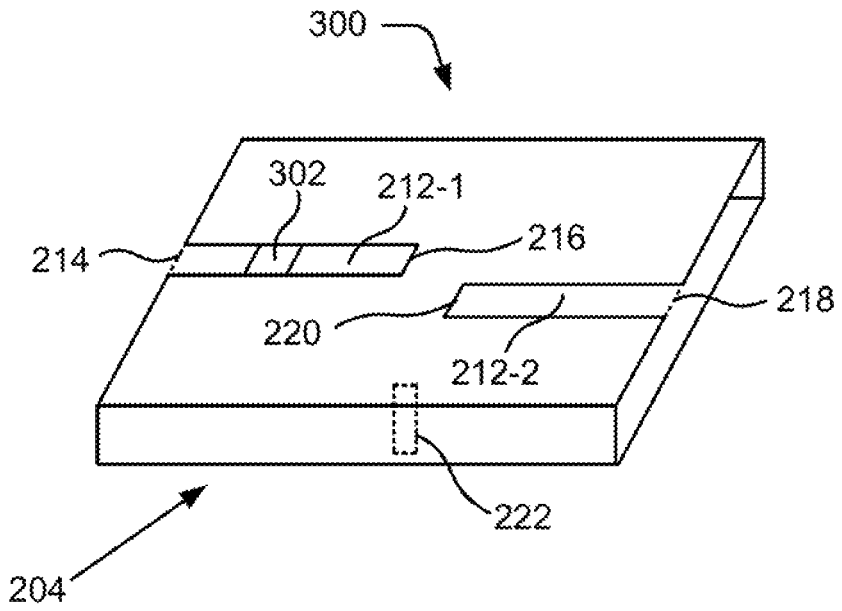
FIG. 3 illustrates an antenna having a lump component, according to an example implementation of the present subject matter.

FIG. 3 illustrates an antenna 300 having a lump component, according to an example implementation of the present subject matter. The antenna 300 includes the features of the antenna 200. The antenna 300 also includes a lump component 302 coupled to the first slot 212-1. In an example implementation, the lump component 302 may be an impedance matching component, such as an inductor or a capacitor used for tuning the antenna 300. In an example implementation, the lump component 302 may be formed by fabricating a printed circuit of an impedance matching component on the antenna holder 204. The lump component 302 allows tuning of operation frequency of the first slot 212-1 and increasing the number of electrical resonances and thereby increasing the bandwidth of the antenna. Although in FIG. 3, the lump component 302 is shown to be positioned on the first slot 212-1, in an example implementation, a lump component may be positioned on the second slot 212-2. In another example implementation, lump components may be positioned on both the first slot 212-1 and the second slot 212-2.

Figure 4:
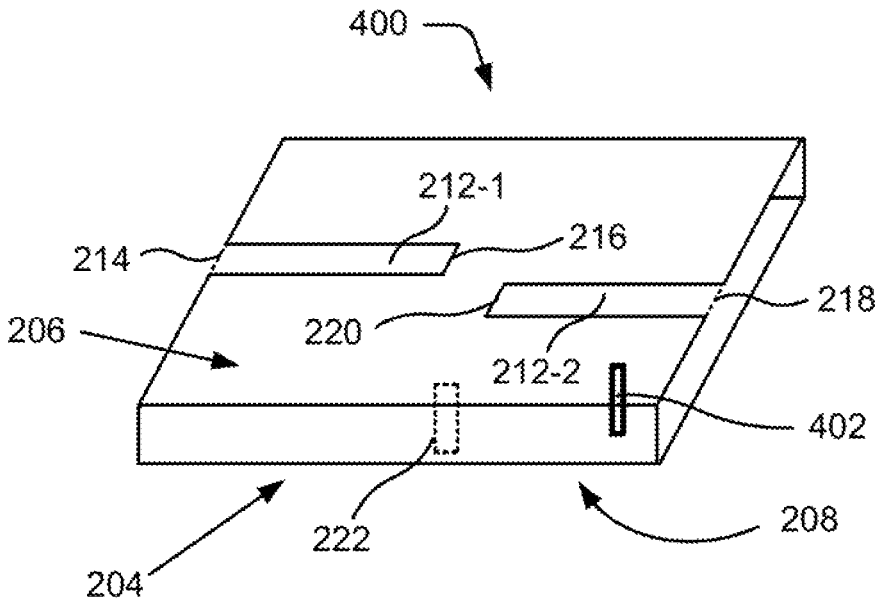
FIG. 4 illustrates an antenna having a grounding pin, according to an, example implementation of the present subject matter.

FIG. 4 illustrates an antenna 400 having a grounding pin, according to an example implementation of the present subject matter. The antenna 400 includes the features of the antenna 200. The antenna 400 includes a grounding pin 402 that connects the radiating surface 206 with the metal plane 208. As shown in FIG. 4, the grounding pin 402 is positioned in a hollow space inside the antenna holder 204 and extends between the radiating surface 206 and the metal plane 208. In an example implementation, the grounding pin 402 is a metallic contact, an end of which may be soldered to the metal plane 208 and other end may be soldered to the radiating surface 206. The grounding pin 402 provides a short circuit path for current flow between the radiating surface 106 and the metal plane 208. The grounding pin 402 may control the variation in current distribution and thereby facilitate in controlling electrical resonances of the antenna 400. Although not shown in FIG. 4, in an example implementation, either of the slots 212-1 and 212-2 of the antenna 400 may be coupled to a lump component, such as the lump component 302 of FIG. 3.

Figure 5:
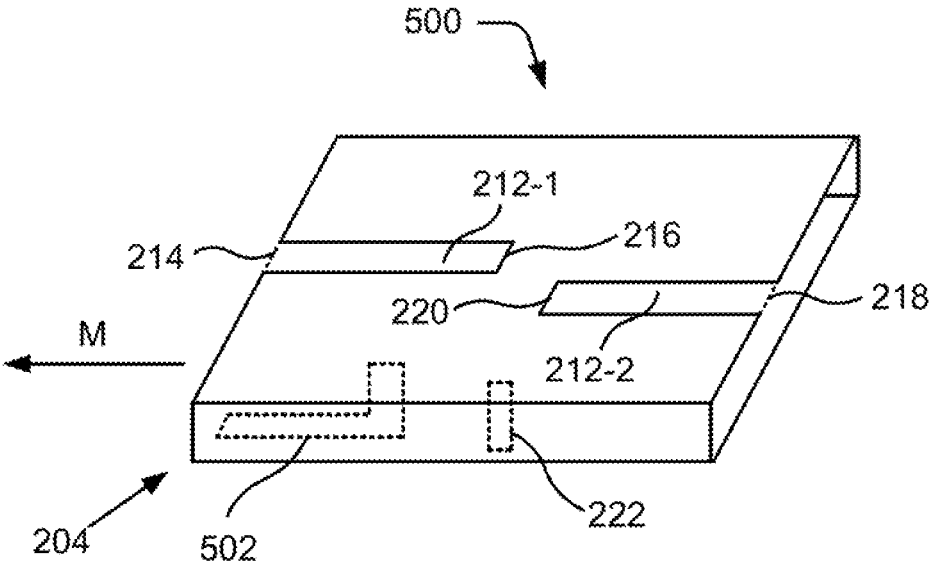
FIG. 5 illustrates an antenna having a monopole radiator, according to an example implementation of the present subject matter.

FIG. 5 illustrates an antenna 500 having a monopole radiator, according to an example implementation of the present subject matter. The antenna 500 includes the features of the antenna 200. The antenna 500 includes a monopole radiator 502. As shown in FIG. 5, the monopole radiator 502 is positioned in a hollow space within the cuboidal antenna holder 204 and extends, in a direction as indicated by arrow M, along the first slot 212-1. Although in FIG. 5, the monopole radiator 502 is illustrated as extending along a length of the first slot 212-1, in an example implementation, a monopole radiator may extend in a direction opposite to that indicated by arrow M. The monopole radiator 502 helps in tuning the operation frequency of the antenna 500. Although in FIG. 5 a single monopole radiator is shown within the antenna holder 204, in an example implementation, more than one monopole radiator may be formed inside the antenna holder 204. Although not shown in FIG. 5, in an example implementation, either of the slots 212-1 and 212-2 of the antenna 500 may be coupled to a lump component, such as the lump component 302 of FIG. 3.

Figure 6:
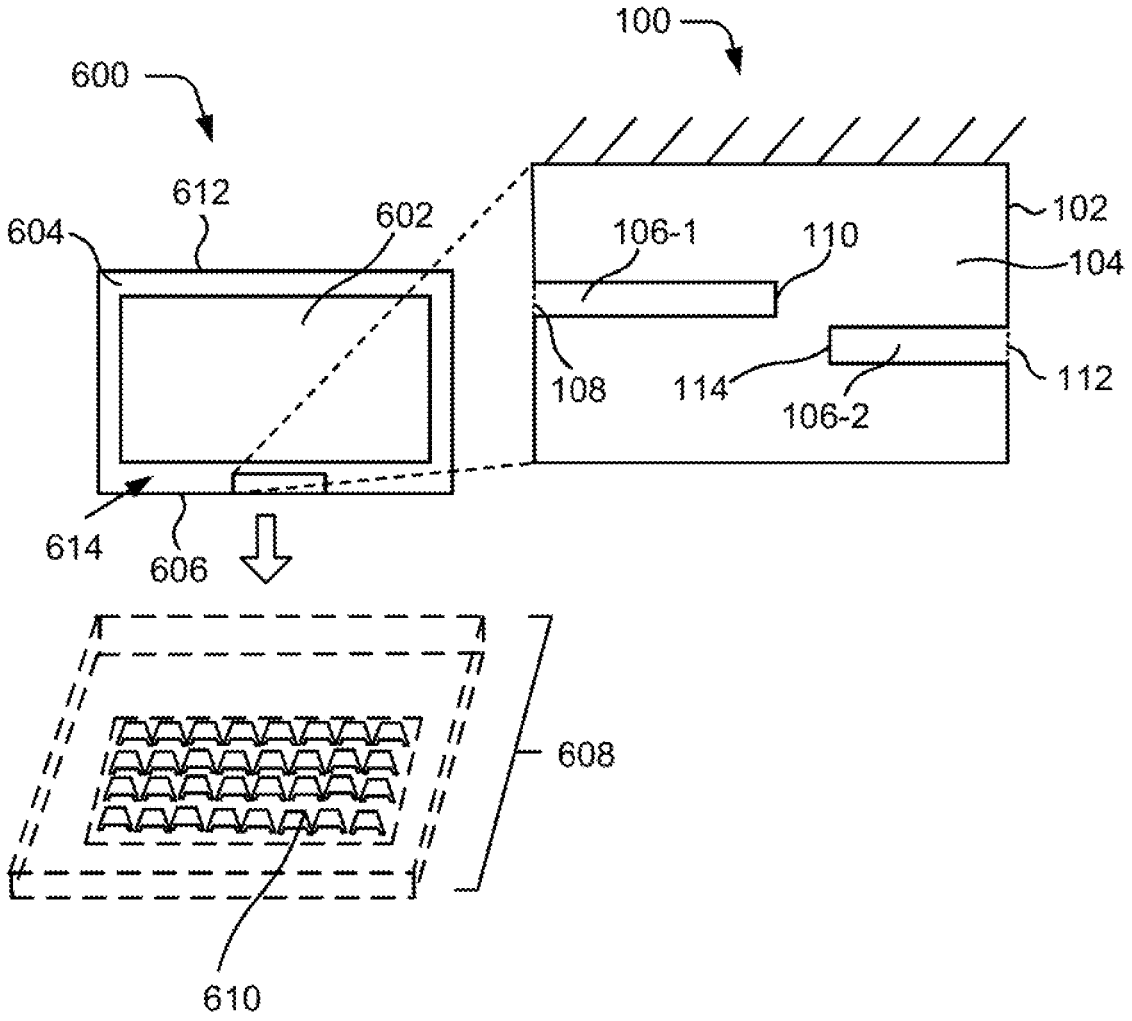
FIG. 6 illustrates a display unit of an electronic device, according to an example implementation of the present subject matter.

FIG. 6 illustrates a display unit 600 of an electronic device, according to an example implementation of the present subject matter. The display unit 600 includes a display panel 602. The display panel 602 may be, for example, a liquid crystal display (LCD) panel or a light emitting diode (LED) panel for rendering visual output of the electronic device. In an example implementation, the display panel 602 may include a touchscreen for receiving touch-based inputs from a user.

The display unit 600 also includes a frame 604 bordering the display panel 602. The frame 604 may be formed from metal and may include a slot (not shown) for mounting of the display panel 602 in the frame 604. The frame 604 may be covered by a plastic casing (not shown).

The display unit 602 further includes the antenna 100 positioned, inside the frame 604, along a first side 606 of the frame 604. The antenna 100 is as illustrated in FIG. 1. The first side 606 is a side through which the frame 604 is couplable to a base unit 608 of the electronic device. The base unit 608 houses a keyboard 610 and encloses a processor, a memory, an I/O port, etc., of the electronic device. In an example implementation, the antenna 100 may also be positioned along a second side 612 of the frame 604, opposite to the first side 606.

As depicted in FIG. 6, the antenna 100 includes a patch antenna element 102. Radiating structures may be formed on a surface 104 of the patch antenna element 102. The surface 104 may be referred to as a radiating surface 104 of the patch antenna element 102. The antenna 100 is positioned inside the frame 604, such that radiations from the radiating surface 104 are emitted out through a front surface 614 of the first side 606. The front surface 614 of the first side 606 may be understood to be extending along a front surface of the display panel 602 on which a visual output is generated.

As shown in FIG. 6, a first slot 106-1 and a second 106-2 are formed on the radiating surface 104. The first slot 106-1 has a first open circuit edge 108 and a first short circuit edge 110. In an example implementation, the first slot 106-1 is tuned to transceive antenna signals at 2.4 Giga Hertz frequency band. The second slot 106-2 has a second open circuit edge 112 and a second short circuit edge 114. In an example implementation, the second slot 106-2 is tuned to transceive antenna signals at 5 Giga Hertz frequency band.

In an example implementation, the antenna positioned inside the frame 604 of the display unit 600 may have a structure and configuration similar to the structure and configuration of the antennas illustrated through FIGS. 2-5. Further, although in FIG. 6 a single antenna is shown to be positioned inside the frame 604, in an example implementation, multiple antennas may be positioned along the sides 606 and 612 of the frame 604.

Figure 7:
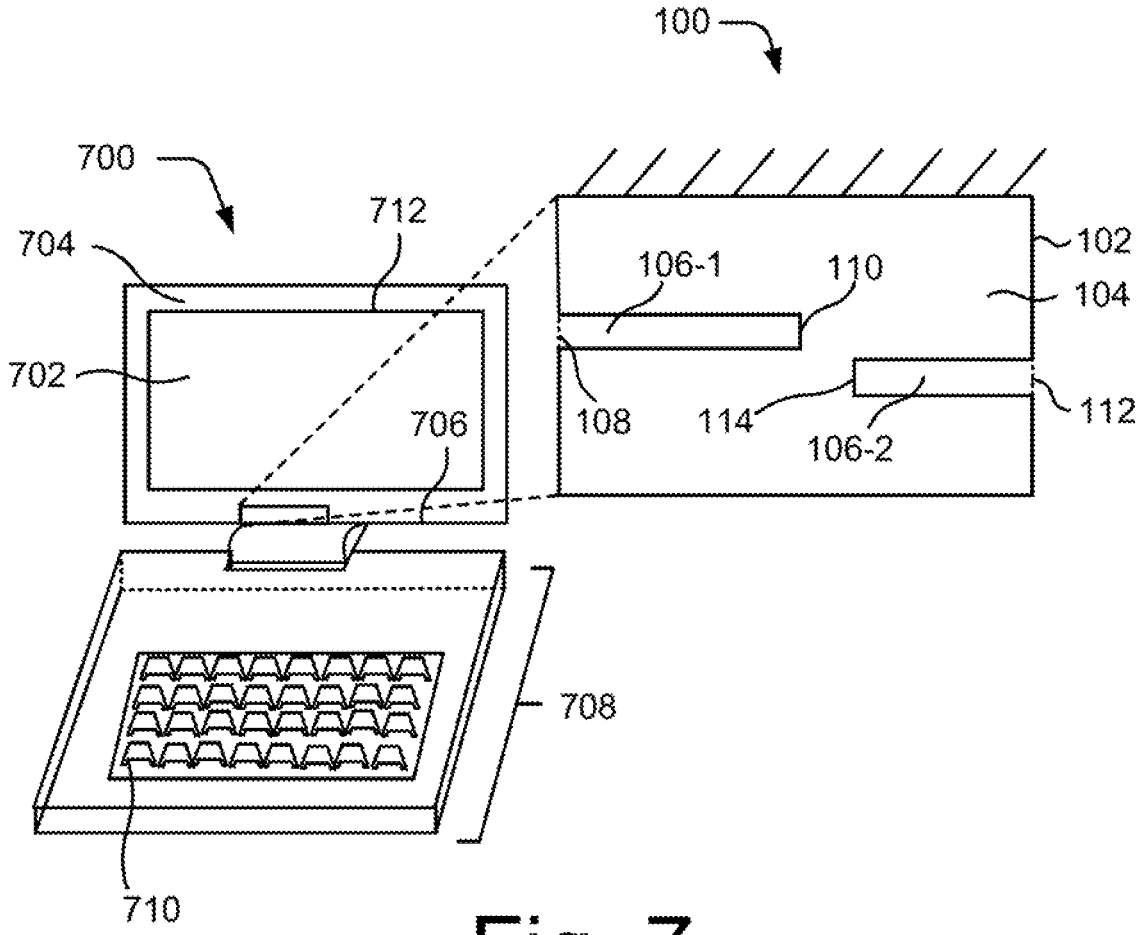
FIG. 7 illustrates an electronic device, according to an example implementation of the present subject matter.

FIG. 7 illustrates an electronic device 700, according to an example implementation of the present subject matter. Examples of the electronic device 700 include a laptop, a tablet, a notebook-tablet convertible, a smart phone, or the like.

The electronic device 700 includes a display panel 702, such as an LCD panel or an LED panel for rendering visual output. The electronic device 700 also includes a frame 704 encasing the display panel 702. The frame 704 may be similar to the frame 604 as illustrated in FIG. 6.

As shown in FIG. 7, the electronic device 700 includes the antenna 100 of FIG. 1, along a first side 706 of the frame 704. The first side 706 is a side through which the frame 704 is coupled to a base unit 708 of the electronic device 700. The base unit 708 houses a keyboard 710 and encloses a processor, a memory, an I/O port, etc., of the electronic device 700. In an example implementation, the antenna 100 may also be positioned along a second side 712 of the frame 704, opposite to the first side 706.

The antenna 100 includes a patch antenna element 110 having an excitation surface 106. The antenna 100 also includes two slots 106-1 and 106-2 formed on the excitation surface 106, as illustrated in FIG. 1.

In an example implementation, the antenna 104 positioned inside the frame 704 may have a structure and configuration similar to the structure and configuration of the antennas illustrated through FIGS. 2-5. Further, although in FIG. 7 a single antenna is shown to be positioned inside the frame 704, in an example implementation, multiple antennas may be positioned along the edges 706 and 712 of the frame 1008.

Although implementations of antennas, display units having such antennas, and electronic devices having such antennas are described in language specific to methods and/or structural features, it is to be understood that the present subject matter is not limited to the specific methods or features described. Rather, the methods and specific features are disclosed and explained as example implementations of antennas, display units having such antennas, and electronic devices having such antennas.

I claim:

1. An antenna comprising:

a patch antenna element having a radiating surface;

two slots formed on the radiating surface, each of the two slots having an open circuit edge and a short circuit edge, wherein the patch antenna element comprises a cuboidal antenna holder, wherein the radiating surface is formed from microstrip patches deposited on a face of the cuboidal antenna holder via a metal paint or an electroplating process, the cuboidal antenna holder comprising:

a metal plane formed on another face of the cuboidal antenna holder opposite to the radiating surface; and a metallic sidewall between the metal plane and the radiating surface, wherein the metallic sidewall is to electrically short the metal plane with the radiating surface; and a monopole positioned within the cuboidal antenna holder and extending along one of the two slots.

2. The antenna as claimed in claim 1, wherein the two slots comprise a first slot to transceive antenna signals at 2.4 Giga Hertz frequency band and a second slot to transceive antenna signals at 5 Giga Hertz frequency band.

3. The antenna as claimed in claim 1, further comprising a lump component coupled to at least one of the two slots.

4. The antenna as claimed in claim 1, further comprising a ground pin that connects the radiating surface with the metal plane.

5. A display unit of an electronic device, comprising:

a display panel;

a frame bordering the display panel, the frame having a first side through which the frame is couplable to a base unit of the electronic device; and an antenna positioned, inside the frame, along one of the first side or a second side of the frame, the second side being opposite to the first side, the antenna comprising:

a patch antenna element having a radiating surface;

a first slot formed on the radiating surface, the first slot having a first open circuit edge and a first short circuit edge, wherein the first slot is to transceive antenna signals at 2.4 Giga Hertz frequency band;

a second slot formed on the radiating surface, the second slot having a second open circuit edge and a second short circuit edge, wherein the second slot is to transceive antenna signals at 5 Giga Hertz frequency band, wherein the patch antenna element comprises a cuboidal antenna holder, wherein the radiating surface is formed from microstrip patches deposited on a face of the cuboidal antenna holder via a metal paint or an electroplating process, the cuboidal antenna holder comprising:

a metal plane formed on another face of the cuboidal antenna holder opposite to the radiating surface; and a metallic sidewall between the metal plane and the radiating surface, wherein the metallic sidewall is to electrically short the metal plane with the radiating surface; and a monopole positioned within the cuboidal antenna holder and extending along one of the first slot or the second slot.

6. The display unit as claimed in claim 5, further comprising a lump component coupled to at least one of the first slot or the second slot.

7. The display unit as claimed in claim 5, wherein the antenna further comprises a ground pin that connects the radiating surface with the metal plane.

8. An electronic device comprising:

a base unit for housing a keyboard;

a display panel;

a frame encasing the display panel, the frame having a first side through which the frame is couplable to the base unit; and an antenna positioned, inside the frame, along one of the first side or a second side of the frame, the second side being opposite to the first side, the antenna comprising:

a patch antenna element having a radiating surface;

a first slot formed on the radiating surface, the first slot having a first open circuit edge and a first short circuit edge, wherein the first slot is to transceive antenna signals at 2.4 Giga Hertz frequency band;

a second slot formed on the radiating surface, the second slot having a second open circuit edge and a second short circuit edge, wherein the second slot is to transceive antenna signals at 5 Giga Hertz frequency band, wherein the patch antenna element comprises a cuboidal antenna holder, wherein the radiating surface is formed from microstrip patches deposited on a face of the cuboidal antenna holder via a metal paint or an electroplating process, the cuboidal antenna holder comprising:

a metal plane formed on another face of the cuboidal antenna holder opposite to the radiating surface; and a metallic sidewall between the metal plane and the radiating surface, wherein the metallic sidewall is to electrically short the metal plane with the radiating surface; and a monopole positioned within the cuboidal antenna holder and extending along one of the first slot or the second slot.

9. The electronic device as claimed in claim 8, wherein the antenna further comprises a ground pin that connects the radiating surface with the metal plane.

* * * * *